US005669186A

United States Patent [19]

Verby et al.

[11] Patent Number: 5,669,186

[45] Date of Patent: Sep. 23, 1997

[54] OPENABLE HATCH APPARATUS FOR A SKYLIGHT

[75] Inventors: Stanley M. Verby, Hewlett Harbor; Barry Mirsky, Hauppauge, both of N.Y.

[73] Assignee: Thermo-Vu Sunlite Industries, Inc., Edgewood, N.Y.

[21] Appl. No.: 536,372

[22] Filed: Sep. 29, 1995

[51] Int. Cl.[6] ..... E04B 7/18

[52] U.S. Cl. ..... 52/72; 52/200

[58] Field of Search ..... 52/72, 200

[56] References Cited

U.S. PATENT DOCUMENTS

| | | | |
|---|---|---|---|
| 1,233,960 | 7/1917 | Bernard . | |
| 2,845,665 | 8/1958 | Place . | |
| 4,073,097 | 2/1978 | Jentoft et al. | 52/200 X |
| 4,409,767 | 10/1983 | Jentoft et al. . | |
| 4,466,221 | 8/1984 | Couture . | |
| 4,570,394 | 2/1986 | Jentoft et al. . | |
| 4,750,302 | 6/1988 | Bechtold . | |
| 4,986,039 | 1/1991 | Weisner | 52/72 |
| 5,103,603 | 4/1992 | Verby et al. . | |
| 5,148,643 | 9/1992 | Sampson et al. | 52/72 X |
| 5,207,036 | 5/1993 | Sampson et al. | 52/72 |

FOREIGN PATENT DOCUMENTS 2124689 2/1984 United Kingdom .

*Primary Examiner*—Carl D. Friedman
*Assistant Examiner*—Yvonne Horton-Richardson
*Attorney, Agent, or Firm*—Darby & Darby

[57] ABSTRACT

An openable skylight apparatus covering a roof opening having a raised curb around its perimeter. The skylight including glazing that substantially covers the opening. A frame assembly surrounds the glazing and has a depending skirt that opposes outer surfaces of the curb. A hinge, joining one side of the frame to the curb includes a bearing within a cradle that allows the frame assembly to pivot to open the skylight. The cradle has a lower and a higher end and extends by an arc greater than 180 degrees and less that a full circle between the ends. The bearing has a periphery that includes a convex surface, two chordal flat surfaces converging toward a lower convex surface and a higher convex surface diametrically opposite the other. When the bearing is rotated to a position in which the lower convex surface is at a higher elevation than the lower end of the cradle, the bearing may be pulled out of the cradle to separate the frame assembly from its hinged connection with the curb.

1 Claim, 1 Drawing Sheet

OPENABLE HATCH APPARATUS FOR A SKYLIGHT

BACKGROUND OF THE INVENTION

The invention relates to an openable hatch apparatus for use in a skylight or roof window and the like for covering a surface opening.

U.S. Pat. No. 5,103,603 discloses an openable skylight, roof window or hatch supported on a curb with respect to the roof. The curb extends perpendicularly from the roof and defines an opening of predetermined shape, for example square, rectangular or trapezoidal. The skylight, roof window or hatch includes a generally T-shaped rail and a frame assembly. The rail and frame assembly are hinged by means of a bearing within a cradle.

The cradle has a concavely curved surface on which the bearing may slidingly rotate. The arc of the curved surface is greater than 180° but less than a full circle so that when the bearing slidingly rotates on the curved surface, a relative position can be reached where a force applied in any direction transverse to the longitudinal axis of the bearing and cradle will be incapable of separating the bearing and curved surface from each other.

When rotation of the bearing on the curved surface results in the cradle clearing the intersection between the curved surface and the flat outer surface on the bearing such that a dimension of the bearing in a direction transverse to the direction of motion of the cradle is less than the opening in the cradle arc, the bearing and cradle separate from each other.

U.S. Pat. No. 5,103,603 also mentions an alternative embodiment of a hinged skylight assembly in which the positions of the cradle and the T-shaped rail may be reversed. That is, the cradle can be part of a longitudinal strip that attaches to the curb and the bearing that rides within the cradle may be connected to the depending skirt. Similar operation of the openable skylight assembly would be possible, with separation from the curb being effected at an angle determined by the contours of the cradle and bearing.

In practice, installers of a hatch constructed in accordance with U.S. Pat. No. 5,103,603 have experienced difficulties in that the installer has to carry the full weight of the heavy frame assembly (for example, 80 to 100 pounds) even after engaging the bearing in the cradle to form the hinged connection until the frame assembly is rotated into a position where the bearing will not slip out of the cradle opening. When one considers that the roof on which the installer is working is pitched, the need to effect such maneuverability of the frame assembly while carrying the full weight of the hatch creates a burden on the installer.

It would therefore be desirable to provide an openable roof hatch whose hinge connection between the frame assembly and the hatch assembly is such that the installer will not have to further rotate the frame assembly relative to the hatch assembly and carry most of the weight of the frame assembly at the same time. It is further desired that the hinged connection avoids the inadvertent slippage of the frame assembly out of its hinged connection to the hatch assembly and yet retain the advantages described in U.S. Pat. No. 5,103,603.

SUMMARY OF THE INVENTION

The present invention is directed to an openable skylight, roof window or hatch that has a hinged connection between a frame assembly and a rail. The hinged connection is formed by a bearing within a cradle; the bearing and cradle are configured so as to permit the weight of the hatch to be carried primarily by the cradle as soon as the bearing is positioned within the cradle to form the hinged connection.

BRIEF DESCRIPTION OF THE DRAWING

For a better understanding of the present invention, reference is made to the following description and accompanying drawings, while the scope of the invention is set forth in the appended claims.

DESCRIPTION OF THE PREFERRED EMBODIMENTS

Figure 1:
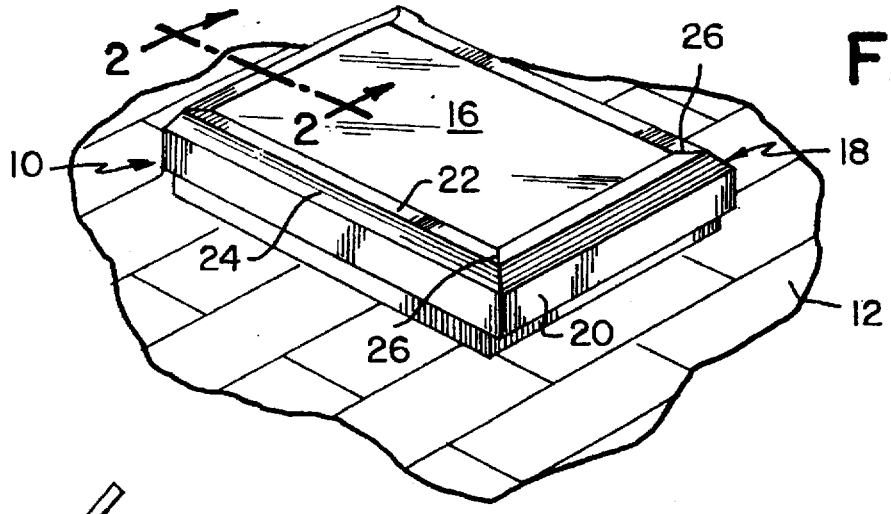
FIG. 1 is a top perspective view of a skylight, roof window or hatch of the openable type in accordance with the invention.

Turning to FIG. 1, a skylight, roof window or hatch assembly 10 is installed on a roof 12 of a structure (not shown). The assembly 10 includes a transparent or translucent glazing member formed of one sheet 16 of glass or plastic material, or in the case of a thermo-insulating arrangement, a plurality of glass or plastic domes 16, fastened in a water-tight fashion within a frame assembly 18. The frame assembly 18 is conventional with regard to the means for retaining the glazing sheet(s) 16 and the seals between adjoining elements.

Except as otherwise mentioned, all the components shown in FIGS. 1–5 have counterparts to those disclosed in U.S. Pat. No. 5,103,603. For the sake of clarity, the same reference numerals are employed in the present drawings as were used in U.S. Pat. No. 5,103,603.

Figure 2:
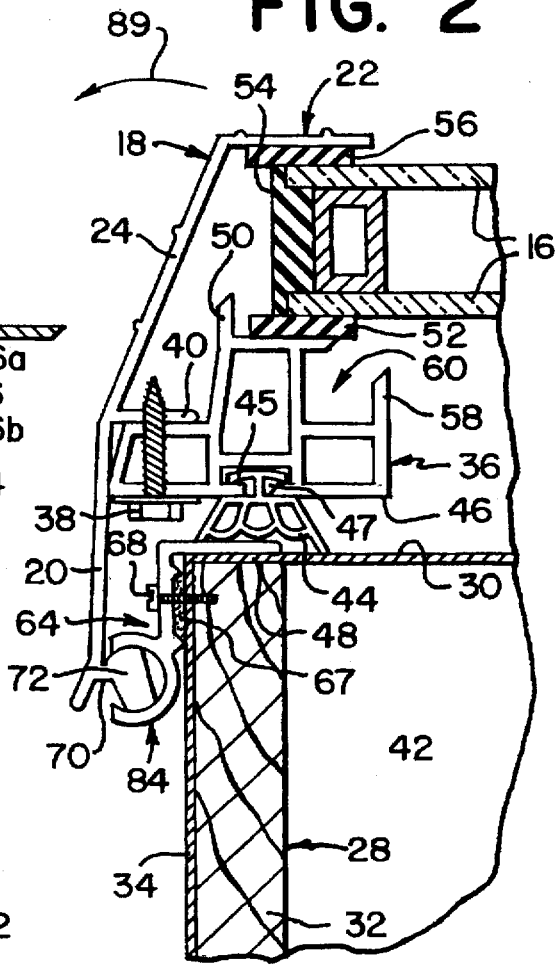
FIG. 2 is a partial section view, in elevation, taken along the line 2—2 of FIG. 1.

The counterparts, as shown in FIG. 2, include those of the frame assembly 18, i.e., a downwardly extending skirt 20, a sloped transition portion 24 between a channel 22 and the skirt 20, mitered joints 26, a raised rectangular curb 28 such as a wood board 32 having a metal cladding 34, and an interface 30 that lies between the curb 28 and the frame assembly 18. The exposed surface of cladding 34 forms the external surface of curb 28. The skirt 20 may slope outwardly from the transition portion 24 at a inclination that is less steep than that of the slope of the transition portion 24.

The counterparts also include a plastic web 36, a self-threading screw 38, a projection 40 through which passes the screw 38, an interior space 42 defined by the rectangular curb 28, a bulbous gasket 44, a web lower surface 46 making contact with a curb upper surface 48, an anchor 45 that extends through a gap 47, an L-shaped frame element 50, a resilient seal 52, a spacer 54, a second resilient seal 56, an inner rim 58 that forms an open channel 60, and a rail 64 that includes a flange 66 that attaches to the curb 28 by means of screws 68 that pass through clearance openings in the flange 66 to enter into and engage the curb 32. Screws 68 alternatively may be received through the horizontal leg of flange 66 into the upper surface of curb 28, for example in the case of a roof window. The shapes of the counterparts of the present application may differ from those depicted in U.S. Pat. No. 5,103,603, yet they provide the same function and structural interactions and are constructed of the same materials. There may also be provided an adhesive 67 that lies in the channel defined between two projections 66*a*, 66*b* (FIG. 3), that run along the full length in the direction of elongation of the flange 66.

Figure 3:
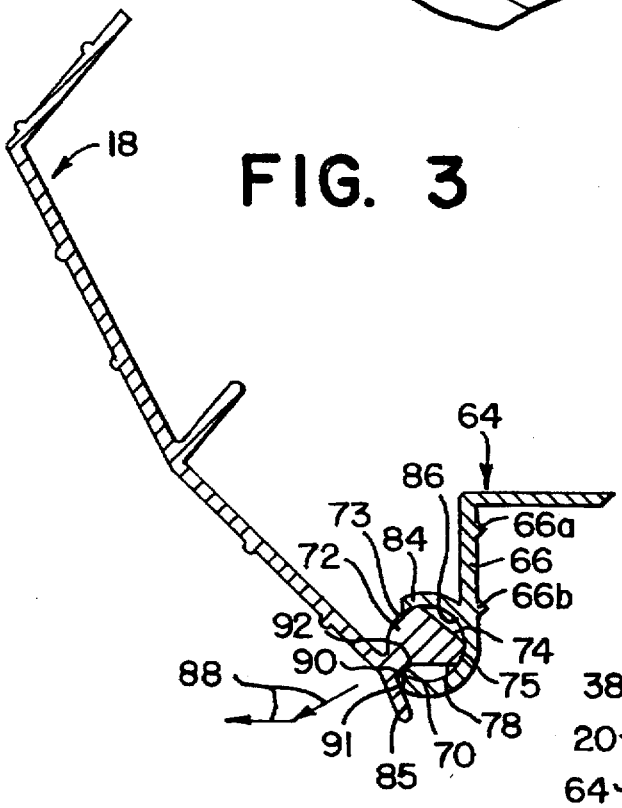
FIG. 3 is a fragmentary sectional view, in elevation of the guide rail and frame assembly in the skylight assembly of FIGS. 1–2, the skylight being open.
Figure 4:
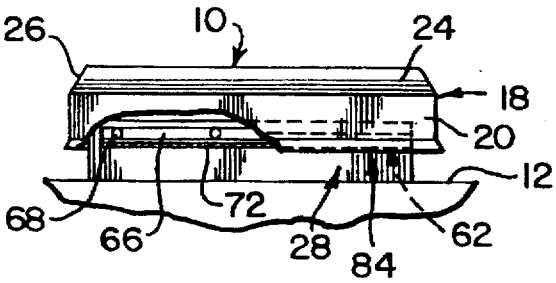
FIG. 4 is a side elevational view, partially cut away to expose the hinge, of the skylight, roof window or hatch of FIG. 1.

As shown in FIG. 4, a hinge assembly 62 pivotally connects the skylight frame assembly 18 to the curb 28. The hinge assembly includes a bearing 72 and a cradle 84 of FIGS. 2 and 3. The components of the hinge assembly are better seen in FIGS. 2 and 3.

Between the bearing 72 and the inside surface of the downwardly extending skirt 20 of the frame assembly 18 is a stem 70. The axial center of the bearing may be at the same elevation as the lower surface of the stem 70.

The peripheral surfaces of the bearing 72 include a proximal convex surface 73 extending from the stem 70 and facing the depending skirt 20, a distal chordal flat surface 74 extending from the distal convex surface 73, a distal convex surface 75 extending from the proximal chordal flat surface 74 and facing away from the skirt 20, and a proximal chordal surface 78 that extends between the distal convex surface 75 and the stem 70. An angular extension 85 extends angularly outward from the base of the stem 70.

Preferably, the proximal chordal flat surface 78 and an edge of the angular extension converge in a direction toward the stem 70, thereby defining a oblique angle between them such as 60 degrees. Also, an oblique angle of 10 to 20 degrees may be defined between the distal chordal flat surface 74 and the proximal chordal flat surface 78 so that both surfaces in effect converge in a direction toward the distal convex surface 75.

The rail 64, on the other hand, includes an L-shaped portion whose flat flange 66 terminates into the cradle 84, which provides a curved surface 86 on which the bearing 72 may slidingly rotate. The arc of the curved surface 86 is greater than 180° but less than a full circle, such as approximately 240°, so that the bearing 72 may be slidingly rotated on the curved surface 86 from a first relative position shown in FIG. 3 to a second relative position shown in FIG. 2. At this second relative position, a force applied in any direction transverse to the longitudinal axis of the bearing and cradle will be incapable of separating the bearing 72 and curved surface 86 from each other. In the first relative position of FIG. 3, the proximal chordal flat surface 78 is substantially perpendicular to the flat flange 66.

However, when rotation of the bearing 72 on the curved surface 86 in the direction 89 of FIG. 2 reaches the relative position of FIG. 3 such that a dimension of the bearing 72 in a direction transverse to the opening in the cradle arc is less than the distance of this opening in the cradle arc, the bearing may be pulled to dislodge the bearing 72 from the cradle. The direction of motion of the bearing relative to the cradle for removal is indicated by the two direction arrows 88. First, the bearing is moved in an angled downward direction until junction 92 reaches the edge of the lower cradle end 90. Next, the bearing is pulled out horizontally, i.e., transverse to the direction of elongation of the flat flange 66.

An advantage of the present invention over that of U.S. Pat. No. 5,103,603 is realized upon installation. The installer simply inserts the bearing 72 into the cradle 84 by positioning the frame assembly so that the bearing can be moved horizontally (left to right) into the cradle. This would mean that the frame is rotated slightly counterclockwise from the position shown in FIG. 3. When the bearing is first inserted, it drops to a position where the cradle end 90 contacts the junction 92 and the installer no longer needs to support the frame assembly. As the frame assembly is then rotated to its closed position (FIG. 2), the bearing rotates through the position shown in FIG. 3 while the contact point between the cradle and stem "travels" toward junction 91. As the installer continues to rotate the frame, the weight is ultimately transferred to the convex surface 75, but regardless of the precise point on which the frame assembly is supported, at all times after the bearing and cradle are engaged, the full weight of the frame assembly is supported by the cradle.

As long as one of the chordal flat surfaces is not in a position to clear the cradle opening, separation of the bearing from the cradle is not possible. It is the relative position and orientation of the bearing surfaces with respect to the cradle that provides clear structural and functional differences over the teaching of U.S. Pat. No. 5,103,603.

In accordance with U.S. Pat. No. 5,103,603, separation of the cradle from the bearing may arise when the cradle is rotated so that its higher end clears the junction between the bearing's distal flat surface and top convex surface. In the present invention, separation of the cradle from the bearing may arise when the bearing is rotated so that its proximal chordal flat surface will clear the lower end of the cradle.

As a result, the bulk of the weight of the frame assembly in accordance with the invention may be carried by the cradle rather than by the installer as soon as the bearing is fitted into a nesting relationship with the cradle, with essentially no danger of the bearing slipping out of the cradle inadvertently.

In addition, the present invention may retain the advantages mentioned in the disclosure of U.S. Pat. No. 5,103,603, such as allowing for adjustment of gasket pressure that incurs little risk of leakage at the hinged connection, and yet eliminates the need for the installer to carry the full weight of the frame assembly while rotating the frame assembly into a covering position relative to the skylight window.

An alternative embodiment of the hinged skylight in accordance with the invention lies in reversal of the positions of the cradle 84 and the bearing 72. That is, the cradle 84 can be part of the depending skirt and the stem 70 may be lengthened to extend from the flange 66. Similar operation of the skylight is possible, with separation from the curb being effected at an angle determined by the contours of the cradle and bearing.

While the foregoing description and drawings represent the preferred embodiments of the present invention, it will be understood that various changes and modifications may be made without departing from the spirit and scope of the present invention.

What is claimed is:

1. An openable hatch apparatus for covering an opening through a surface of a structure, said opening having a raised curb defining the perimeter of said opening, said raised curb including an external curb surface extending substantially perpendicularly away from said structure surface, said hatch assembly comprising:

covering means having a geometric shape and size suitable for substantially covering said opening;

a frame assembly surrounding the periphery of said covering means and having a depending skirt portion, said depending skirt portion opposing and being spaced from said external curb surface when said hatch assembly is joined to said raised curb;

a stem extending from said depending skirt and a bearing joined to said stem, said bearing having a periphery that includes a convex surface and at least one chordal flat surface, said stem and said depending skirt defining a junction therebetween; and a flange adapted to be connected to the curb and including a cradle in which said bearing can be rotatably mounted, said cradle defining an arc greater than 180° and having an opening which faces outwardly from the external curb surface, the shape of the bearing being such relative to the cradle that it can be (a) placed horizontally into the cradle through said opening when the frame assembly is in a predetermined position, and (b) rotated within said cradle to a position in which it cannot be removed from the cradle, whereby substantially the entire weight of the frame assembly may rest on the stem or bearing and be supported by the cradle after the bearing has been inserted into said cradle.

* * * * *